US009222631B2

(12) United States Patent
Lam

(10) Patent No.: US 9,222,631 B2
(45) Date of Patent: Dec. 29, 2015

(54) ELECTRIC TORCH

(71) Applicant: Daniel Kai Yu Lam, Kowloon (HK)

(72) Inventor: Daniel Kai Yu Lam, Kowloon (HK)

( * ) Notice: Subject to any disclaimer, the term of this patent is extended or adjusted under 35 U.S.C. 154(b) by 250 days.

(21) Appl. No.: 13/961,910

(22) Filed: Aug. 8, 2013

(65) Prior Publication Data

US 2014/0177213 A1 Jun. 26, 2014

(30) Foreign Application Priority Data

Dec. 20, 2012 (HK) ..... 12113154.1

(51) Int. Cl.
*F21L 4/00* (2006.01)

(52) U.S. Cl.
CPC ..... *F21L 4/005* (2013.01)

(58) Field of Classification Search
None
See application file for complete search history.

(56) References Cited

U.S. PATENT DOCUMENTS 5,353,208 A * 10/1994 Moore ..... F21L 4/005 362/202
2005/0036307 A1* 2/2005 Wang ..... 362/157
2010/0231142 A1 9/2010 Yoon

FOREIGN PATENT DOCUMENTS

CN 202172095 U 3/2012
CN 202419151 U 9/2012

OTHER PUBLICATIONS

Search Report of Hong Kong Short-term Patent Application No. 12113154.1 issued on Jan. 18, 2013.
1st Office Action of counterpart Chinese Patent Application No. 201310347386.9 issued on Feb. 2, 2015.

* cited by examiner

*Primary Examiner* — Britt D Hanley

(57) ABSTRACT

An electric torch includes an enclosure for housing at least two battery units, a head portion, a front connecting unit secured to a front end of the enclosure, and a rear connecting unit secured to a rear end of the enclosure opposite to the front end. The front connecting unit and the rear connecting unit are electrically connected to opposite terminals of the at least two battery units, to connect the at least two battery unit in serial or parallel, or in combination of serial and parallel connection to act as the power supply of the electric torch. The power supply includes a first electrode and a second electrode with the polarity thereof reverse to the polarity of the first electrode.

18 Claims, 3 Drawing Sheets

ELECTRIC TORCH

BACKGROUND

1. Technical Field

The present disclosure relates to electric torches for supplying illumination.

2. Description of Related Art

Electric torches are widely used for illuminating because of its small size and portability. A plurality of batteries housed in the enclosure of the portable electric torch are connected in series to form a DC power source for powering the lamp. However, because the batteries are connected in series, the length of the enclosure should be long enough to accommodate the batteries, which result in the electric torch being carried and used inconveniently.

A plurality of batteries connected in combination of serial and parallel connection may be also used by some electric torches. However, to achieve the batteries being connected in combination of serial and parallel connection, an external auxiliary enclosure must be designed, which may result in increment of the manufacturing cost and production management and storage being more complicated.

Therefore, there is a room for improvement in the art.

SUMMARY

Embodiments of the present invention relate to an electric torch capable of accommodating a plurality of batteries in a relatively miniature enclosure.

An embodiment of the electric torch includes an enclosure for housing at least two battery units, a head portion, a front connecting unit secured to a front end of the enclosure, and a rear connecting unit secured to a rear end of the enclosure opposite to the front end. The front connecting unit and the rear connecting unit are electrically connected to opposite terminals of the at least two battery units, to connect the at least two battery unit in serial or parallel, or in combination of serial and parallel connection to act as the power supply of the electric torch. The power supply includes a first electrode and a second electrode with the polarity thereof reverse to the polarity of the first electrode.

Wherein, the electric torch further includes a rear cover detachably secured to the rear end of the enclosure, the rear connecting unit is mounted in the rear cover.

Wherein, a limiting mechanism is mounted to the rear connecting unit and the enclosure, the limiting mechanism makes the rear connecting unit and the enclosure being fixed in a circular fixation mode.

Wherein, the rear cover defines a latching slot, the rear connecting unit is rotatably embedded into the latching slot.

Wherein, the limiting mechanism includes at least one limiting post secured to the rear connecting unit and at least one limiting hole defined on the enclosure for allowing the at least one limiting post being inserted thereinto.

Wherein, the front connecting unit includes a first contact electrically connected to the first electrode, the rear connecting unit includes a second contact electrically connected to the second electrode, the front connecting unit further includes a third contact, the third contact is electrically connected to the second contact by at least one conducting pathway.

Wherein, the at least one conducting pathway includes a first conducting pathway, the first conducting pathway includes at least one conductive limiting post and the enclosure; the at least one limiting post is electrically connected to the second contact; the enclosure is conductive, the front end of the enclosure is electrically connected to the third contact, the rear end of the enclosure is electrically connected to the at least one limiting post.

Wherein, the at least one conducting pathway includes a second conducting pathway, the second conducting pathway includes a conducting sheet longitudinally disposed within and insulated from the enclosure, opposite ends of the conducting sheet are electrically connected to the second contact and the third contact.

Wherein, a conducting sheet is longitudinally disposed within and insulated from the enclosure, the conducting sheet acts as a communication link for electrically connecting the front connecting unit with the rear connecting unit.

Wherein, an end of the conducting sheet with an elastic contact is electrically and detachably connected to the second contact.

Wherein, an end of the conducting sheet with an elastic contact is electrically and detachably connected to the second contact.

Wherein, the rear cover and the enclosure are conductive; the at least one conducting pathway includes a third conducting pathway, the third conducting pathway includes the rear cover and the enclosure, the rear cover is electrically connected to the second contact, and the front end of the enclosure is electrically connected to the third contact.

Wherein, the enclosure defines at least two receiving grooves for receiving the at least two battery units, the at least two receiving grooves extend longitudinally.

Wherein, the at least two receiving grooves communicate with each other, the cross section of each receiving groove is substantially sector shaped, the central angle of the sector shaped of each receiving groove is greater than 180 degrees, and the distance between two center points of the sectors is not less than the diameter of each sector.

Wherein, the enclosure includes at least two protrusions, each protrusion is arranged between two adjacent receiving grooves, one of the protrusions defines a through hole extending longitudinally and communicating with one of the adjacent receiving groove, the through holes is used for mounting the conducting sheet.

Wherein, the other of the at least one protrusions defines the at least one limiting hole.

Wherein, the cross section of the enclosure is substantially sector shaped.

Wherein, the enclosure is integrally formed by aluminium.

Wherein, a mounting ring is arranged at the front end of the enclosure for mounting the head portion, the joint of the mounting ring and the receiving grooves forms a step for mounting the front connecting unit.

Wherein, the electric torch further includes a rear cover, the rear cover and the enclosure are integrally arrangement, the rear connecting unit is mounted in the rear cover; the front connecting unit is rotatably mounted in the head portion, and is further mounted to the enclosure in a circular fixation mode; the head portion defines a latching slot, the front connecting unit is rotatably mounted into the latching slot; at least one limiting posts is secured to the front connecting unit, and the enclosure defines at least one limiting hole for allowing the at least one limiting post to be inserted thereinto; the enclosure defines at least two receiving grooves for receiving the at least two battery units, the at least two receiving grooves extend longitudinally; the at least two receiving grooves communicate with each other, the cross section of each receiving groove is substantially sector shaped, the central angle of the sector shaped of each receiving groove is greater than 180 degrees, and the distance between two center points of the sectors is not less than the diameter of each sector; the enclosure includes at least two protrusions, each protrusion is arranged between two adjacent receiving grooves, one of the protrusions defines a through hole extending longitudinally and communicating with one of the adjacent receiving groove, the through holes is used for mounting a conducting sheet, the conducting sheet insulates from the enclosure, opposite ends of the conducting sheet are electrically connected to the second contact and the third contact; the other of the at least one protrusions defines the at least one limiting hole; the cross section of the enclosure is substantially sector shaped; the enclosure is integrally formed by aluminium; and the at least one limiting hole includes two limiting holes, The at least two protrusions includes three protrusions, each protrusion is arranged between two of the receiving groove, one of the protrusions defines the through hole, the rest two protrusions defines the two limiting holes.

In present invention, the front connecting unit and the rear connecting unit connect at least three battery units in serial, the electric torch is enable to accommodate a plurality of batteries connected in serial in a relatively miniature enclosure, without additional external auxiliary enclosure, whereby the electric torch is miniaturized to be conveniently carried and used.

The following detailed description, together with the accompanying drawings will provide a better understanding of the nature and advantages of the present invention.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts through out the several views.

DETAILED DESCRIPTION

The disclosure is illustrated by way of example and not by way of limitation in the figures of the accompanying drawings in which like reference indicate similar elements. It should be noted that reference to "an" or "one" embodiment in the disclosure are not necessarily to the same embodiment, and such references mean "at least one".

Figure 1:
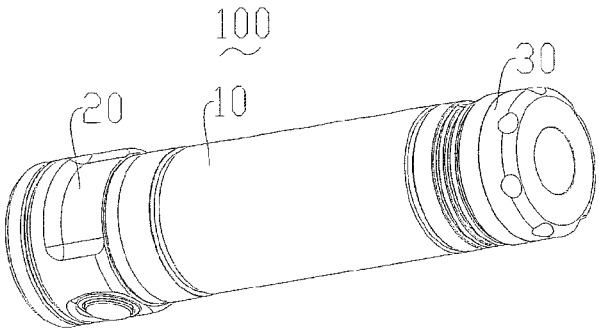
FIG. 1 is a schematic view of an electric torch in accordance with a first embodiment.
Figure 2:
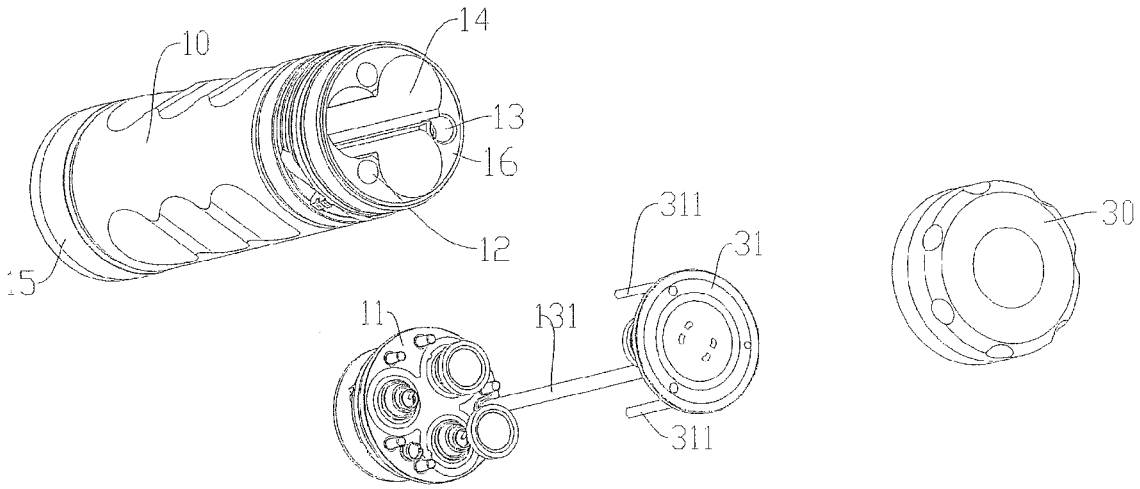
FIG. 2 is a disassembled view of the electric torch of FIG. 1; the electric torch includes an enclosure, a front connecting unit, and a rear connecting unit.

FIGS. 1 and 2 illustrate an electric torch 100. The electric torch 100 includes an enclosure 10, a head portion 20, and a rear cover 30. The enclosure 10 and the rear cover 30 are substantially cylindrical, and has a substantially circular cross section. The enclosure 10 and the rear cover 30 in the embodiment are integrally formed by aluminium. Because aluminium is a metal having low density, high electrical conductivity and ductile, and capable of resisting corrosion after being anointed, the electric torch 100 is lightweight to be carried. An LED lamp having a MCU (not shown) is mounted to the head portion 20, with high luminous deficiency and low power consumption. The head portion 20 and the rear cover 30 are threadedly connected to opposite ends of the enclosure 10, to allow the electric torch 100 being easily disassembled.

The electric torch 100 further includes a front connecting unit 11 and a rear connecting unit 31. The front connecting unit 11 and the rear connecting unit 31 are mounted to opposite ends of the enclosure 10. The front connecting unit 11 and the rear connecting unit 31 connects three battery units (not shown) housed in the enclosed 10 in serial or in combination of serial and parallel connection, to power the electric torch 100. Each battery unit includes one or more batteries being connected in serial. Each battery unit in the embodiment includes two batteries being connecting in serial. The rear connecting unit 31 and the front connecting unit 11 are electrically connected to opposite terminals of the battery units, to connect the 6 batteries in serial, to power the electric torch 100. Because of the 6 batteries housed in the relativity miniature enclosure 10, requirement of luminous can be satisfied, and the electric torch 100 can be easily carried.

It is understood that, the front connecting unit 11 and the rear connecting unit 31 can be in a form of a printed circuit board. The front connecting unit 11 and the rear connecting unit 31 can also be in a form of a plastic plate, with the conducting positions where the batteries contact being replaced by metal sheet.

The enclosure 10 and the rear cover 30 are threadedly and detachably connected with each other. The rear connecting unit 31 is rotatably disposed within the rear cover 30. A limiting mechanism (not shown) is mounted to the rear connecting unit 31 and the enclosure 10. The limiting mechanism (not shown) makes the rear connecting unit 31 and the enclosure 10 being fixed in a circular fixation mode. As a result, when the rear cover 30 rotates around the enclosure 10, the rear connecting unit 31 keeps static relative to the enclosure 10, thereby misplacement and damage of electrodes can be avoided.

In detail, the rear cover 30 defines a latching slot (not shown), and the rear connecting unit 31 is rotatably embedded into the latching slot. The limiting mechanism includes at least one limiting post 311 secured to the rear connecting unit 31 and a limiting hole 12 defined on the enclosure 10 for allowing the at least one limiting post 311 being inserted thereinto. In another embodiment, the at least one limiting post 311 may be secured to the enclosure 10, and the limiting hole 12 is defined at the rear connecting unit 31 for allowing the at least one limiting post 311 being inserted thereinto.

The three battery units connected in serial to act as the power supply of the electric torch 100. The power supply includes a first electrode and a second electrode. The polarities of the first electrode and the second electrode are reversed. The front connecting unit 11 includes a first contact electrically connected to the first electrode, the rear connecting unit 31 includes a second contact electrically connected to the second electrode. The first and second contacts may be metal sheet, conductive metallic ball, or the like. The front connecting unit 11 further includes a third contact. The third contact is electrically connected to the second contact by three conducting pathways, to allow the head portion 20 being electrically connected between the first contact and the third contact.

Figure 4:
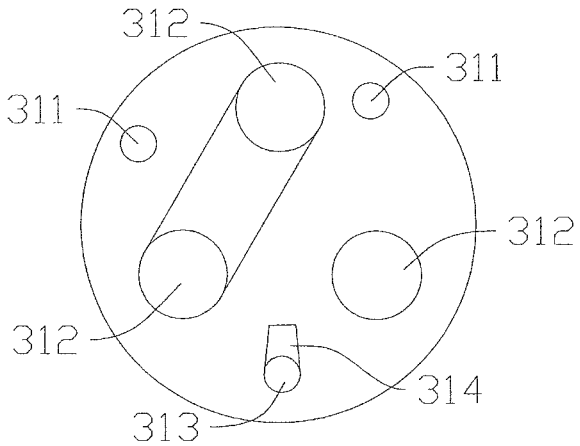
FIG. 4 is a schematic view of the rear connecting unit of FIG. 2, while viewed from one aspect.
Figure 5:
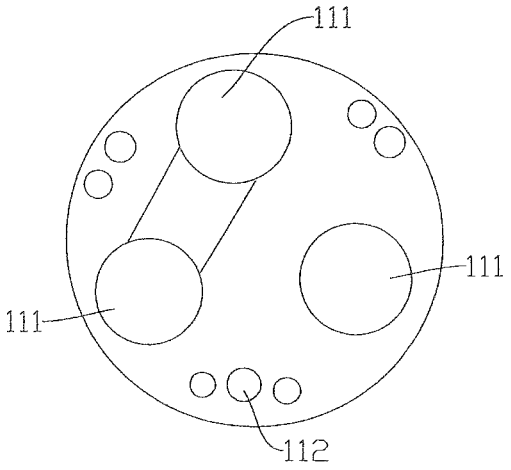
FIG. 5 is a schematic view of the front connecting unit of FIG. 2, while viewed from on aspect.

Referring to FIGS. 4 and 5, the front connecting unit 11 and the rear connecting unit 31 are substantially circular shaped. Three elastic contacts 111 are arranged on a surface of the front connecting unit 11 opposite to the first contact. Three elastic contacts 312 are arranged on a surface of the rear connecting unit 31 opposite to the second contact. The elastic contacts 111, 312 electrically abut the corresponding polarities of the electrodes of the battery. In each printed circuit board, two of the three contacts 111, 312 are electrically connected to each other by the circuit arranged in the printed circuit board, the rest elastic contact extends through a conducting hole 314 and is electrically connected to the contact opposite to the elastic contacts.

Because the third contact is electrically connected to the second contact by the three conducting pathways, the electric torch 100 is prevented from being disabled because of disconnecting of one of the conducting pathways. As a result, the electric torch 100 retains stability when used. Detail of the three pathways (hereinafter, a first conducting pathway, a second conducting pathway, and a third conducting pathway) are described as following:

The first conducting pathway includes two limiting posts 311 secured to the front connecting unit 31 and the enclosure 10. The limiting posts 311 are conductive, and are electrically connected to the second contact. Because the enclosure 10 is made of aluminium having conducting property, and the front end thereof is electrically connected to the third contact of the front connecting unit 11, the rear end thereof is electrically connected to the two limiting posts 311.

The second conducting pathway includes a conducting sheet 131. The conducting sheet 131 is longitudinally disposed within the enclosure 10. An end of the conducting sheet 131 is electrically connected to the contact 313 of the rear connecting unit 31, wherein the contact 313 extends through the conducting hole 314 defined on the rear connecting unit 31 and is electrically connected to the second contact. The other end of the conducting sheet 131 extends through a round hole 112 defined on the front connecting unit 11 and is further electrically connected to the third contact. The conducing sheet 131 insulates from the enclosure 10. Furthermore, the end of the conducting sheet 131 and the second contact are detachably connected. An elastic contact is arranged on the said end of the conducting sheet 131 connected to the second contact for easy electrical connection.

It is understood that the conducting sheet 131 can be used as a communication link. An end of the conducting sheet 131 extends the round hole 112, and is further electrically connected to the MCU of the LED, the other end of the conducting sheet 131 is electrically connected to the contact 313 of the rear connecting unit 31, and is further electrically connected to a terminal of a switch (not shown) mounted to the enclosure 10 or the rear cover 30. The other terminal of the switch is grounded. Thus, when the switch is actuated by users, grounded signal is transmitted to the induction pin of the MCU, and the MCU is actuated to turn on/off the LED lamp, or adjust the brightness and outputting manner of the LED lamp. When no grounded signal is received, the MCU is disabled. The conducting sheet 131 can be replaced by wires.

The third pathway includes the rear cover 30 and the enclosure 10. The rear cover 30 is electrically connected to the second contact. The front end of the enclosure 10 is electrically connected to the third contact.

The enclosure 10 is substantially hollow cylindrical, and is adapted to house the three battery units. Each battery unit includes two batteries connected in serial. The enclosure 10 defines three receiving grooves 14 for receiving the three battery units.

Figure 3:
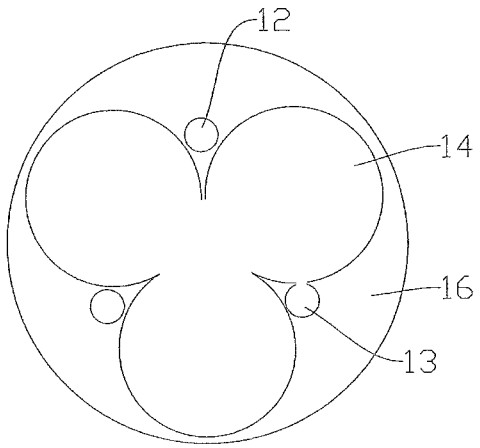
FIG. 3 is a schematic view for showing a cross section of the enclosure in FIG. 2.

Referring to FIG. 3, the cross section of each receiving groove 14 is substantially sector shaped. The receiving grooves 14 communicate with each other. The receiving grooves 14 extend longitudinally. To prevent the batteries from sliding out of the receiving groove 14, the central angle of the sector shaped of each receiving groove 14 is greater than 180 degrees. To achieve the batteries being installed perfectly, the distance between two center points of the sectors is not less than the diameter of each sector. The depth of each receiving groove 14 is the sum of the length of two batteries. Because the receiving grooves 14 communicate with each other, the receiving grooves 14 are easily formed to save more material, and the batteries are easily to be installed. In another embodiments, the receiving grooves 14 are spaced apart from each other with the shaped of the cross section being circular.

The enclosure 10 further includes three protrusions 16. Each protrusion 16 is arranged between two adjacent receiving grooves 14. One of the protrusions 16 defines a through hole 13 extending longitudinally and communicating with one of the adjacent receiving groove 14. The through holes 13 allows the conducting sheet 131 to be inserted thereinto and to be mounted therein. The shaped of the through holes 13 is substantially sector shaped. The rest two protrusions 16 defines two limiting holes 12.

A mounting ring 15 is arranged at the front end of the enclosure 10 for mounting the head portion 20. The mounting ring 15 is integrally formed to the enclosure 10. The inner sidewall of the mounting ring 15 defines a plurality of threads, to allow the head portion 20 to be threadedly engaged therewith. A step is formed at the joint of the mounting ring 15 and the receiving grooves 14. The front connecting unit 11 is mounted to the step by bolts.

In a second embodiment, the rear cover 30 and the enclosure 10 are integrally arrangement, the rear connecting unit 31 is mounted in the rear cover 30, and the batteries is installed into the enclosure 10 via the front end of the enclosure 10.

The front connecting unit 11 is rotatably mounted in the head portion 20. The front connecting unit 11 is further mounted to the enclosure 10 in a circular fixation mode. As a result, when the head portion 20 rotates around the enclosure 10, the front connecting unit 11 keep static relative to the enclosure 10. The head portion 20 further defines a latching slot. The front connecting unit 11 is rotatably mounted into the latching slot. Two limiting posts 311 are secured to the front connecting unit 11. The enclosure 10 defines two limiting holes 12 for allowing the limiting posts 311 to be inserted thereinto.

The enclosure 10 is integrally formed by aluminium. The shape of the cross section of the enclosure 10 is substantially circular. The enclosure 10 defines three receiving grooves 14 for receiving the battery units. The receiving grooves 14 communicate with each other. The receiving grooves 14 extend longitudinally. The cross section of each receiving groove 14 is substantially sector shaped. To prevent the batteries from sliding out of the receiving groove 14, the central angle of the sector shaped of each receiving groove 14 is greater than 180 degrees, and the distance between two center points of the sectors is not less than the diameter of each sector. The enclosure 10 further includes three protrusions 16. Each protrusion 16 is arranged between two of the receiving groove 16. One of the protrusions 16 defines a through hole 13 extending longitudinally. The through hole 13 communicates with one of adjacent receiving grooves 14. The conducting sheet 131 is mounted into the through hole 13. Opposite ends of the conducting sheet 131 are electrically connected to the front connecting unit 11 and the rear connecting unit 31. The conducting sheet 131 insulates from the enclosure 10. The limiting holes 12 are defined at the rest two protrusions 16.

Although information as to, and advantages of, the present embodiments have been set forth in the foregoing description, together with details of the structures and functions of the present embodiments, the disclosure is illustrative only; and changes may be made in detail, especially in the matters of Shae, size, and arrangement of parts within the principles of the present embodiments to the full extent indicated by the broad general meaning of the terms in which the appended claims are expressed.

What is claimed is:

1. An electric torch, comprising: an enclosure for housing at least two battery units; a head portion; a front connecting unit secured to a front end of the enclosure; and a rear connecting unit secured to a rear end of the enclosure opposite to the front end; wherein the front connecting unit and the rear connecting unit are electrically connected to opposite terminals of the at least two battery units, to connect the at least two battery unit in serial or parallel, or in combination of serial and parallel connection to act as the power supply of the electric torch; the power supply comprises a first electrode and a second electrode with the polarity thereof reverse to the polarity of the first electrode;

the electric torch further comprises a rear cover detachably secured to the rear end of the enclosure, wherein the rear connecting unit is mounted in the rear cover;

wherein a limiting mechanism is mounted to the rear connecting unit and the enclosure, the limiting mechanism makes the rear connecting unit and the enclosure being fixed in a circular fixation mode.

2. The electric torch of claim 1, wherein the rear cover defines a latching slot, the rear connecting unit is rotatably embedded into the latching slot.

3. The electric torch of claim 1, wherein the limiting mechanism comprises at least one limiting post secured to the rear connecting unit and at least one limiting hole defined on the enclosure for allowing the at least one limiting post being inserted thereinto.

4. The electric torch of claim 3, wherein the front connecting unit comprises a first contact electrically connected to the first electrode, the rear connecting unit comprises a second contact electrically connected to the second electrode, the front connecting unit further comprises a third contact, the third contact is electrically connected to the second contact by at least one conducting pathway.

5. The electric torch of claim 4, wherein the at least one conducting pathway comprises a first conducting pathway, the first conducting pathway comprises at least one conductive limiting post and the enclosure; the at least one limiting post is electrically connected to the second contact; the enclosure is conductive, the front end of the enclosure is electrically connected to the third contact, the rear end of the enclosure is electrically connected to the at least one limiting post.

6. The electric torch of claim 5, wherein the at least one conducting pathway comprises a second conducting pathway, the second conducting pathway comprises a conducting sheet longitudinally disposed within and insulated from the enclosure, opposite ends of the conducting sheet are electrically connected to the second contact and the third contact.

7. The electric torch of claim 5, wherein a conducting sheet is longitudinally disposed within and insulated from the enclosure, the conducting sheet acts as a communication link for electrically connecting the front connecting unit with the rear connecting unit.

8. The electric torch of claim 6, wherein an end of the conducting sheet with an elastic contact is electrically and detachably connected to the second contact.

9. The electric torch of claim 7, wherein an end of the conducting sheet with an elastic contact is electrically and detachably connected to the second contact.

10. The electric torch of claim 5, wherein the rear cover and the enclosure are conductive; the at least one conducting pathway comprises a third conducting pathway, the third conducting pathway comprises the rear cover and the enclosure, the rear cover is electrically connected to the second contact, and the front end of the enclosure is electrically connected to the third contact.

11. The electric torch of claim 10, wherein the enclosure defines at least two receiving grooves for receiving the at least two battery units, the at least two receiving grooves extend longitudinally.

12. The electric torch of claim 11, wherein the at least two receiving grooves communicate with each other, the cross section of each receiving groove is substantially sector shaped, the central angle of the sector shaped of each receiving groove is greater than 180 degrees, and the distance between two center points of the sectors is not less than the diameter of each sector.

13. The electric torch of claim 12, wherein the enclosure comprises at least two protrusions, each protrusion is arranged between two adjacent receiving grooves, one of the protrusions defines a through hole extending longitudinally and communicating with one of the adjacent receiving groove, the through holes is used for mounting the conducting sheet.

14. The electric torch of claim 13, wherein the other of the at least one protrusions defines the at least one limiting hole.

15. The electric torch of claim 14, wherein the cross section of the enclosure is substantially sector shaped.

16. The electric torch of claim 15, wherein the enclosure is integrally formed by aluminium.

17. The electric torch of claim 16, wherein a mounting ring is arranged at the front end of the enclosure for mounting the head portion, the joint of the mounting ring and the receiving grooves forms a step for mounting the front connecting unit.

18. An electric torch, comprising:

an enclosure for housing at least two battery units;

a head portion;

a front connecting unit secured to a front end of the enclosure; and a rear connecting unit secured to a rear end of the enclosure opposite to the front end;

wherein the front connecting unit and the rear connecting unit are electrically connected to opposite terminals of the at least two battery units, to connect the at least two battery unit in serial or parallel, or in combination of serial and parallel connection to act as the power supply of the electric torch;

the power supply comprises a first electrode and a second electrode with the polarity thereof reverse to the polarity of the first electrode;

wherein further comprises a rear cover, wherein:

the rear cover and the enclosure are integrally arrangement, the rear connecting unit is mounted in the rear cover;

the front connecting unit is rotatably mounted in the head portion, and is further mounted to the enclosure in a circular fixation mode;

the head portion defines a latching slot, the front connecting unit is rotatably mounted into the latching slot;

at least one limiting posts is secured to the front connecting unit, and the enclosure defines at least one limiting hole for allowing the at least one limiting post to be inserted thereinto;

the enclosure defines at least two receiving grooves for receiving the at least two battery units, the at least two receiving grooves extend longitudinally;

the at least two receiving grooves communicate with each other, the cross section of each receiving groove is substantially sector shaped, the central angle of the sector shaped of each receiving groove is greater than 180 degrees, and the distance between two center points of the sectors is not less than the diameter of each sector;

the enclosure comprises at least two protrusions, each protrusion is arranged between two adjacent receiving grooves, one of the protrusions defines a through hole extending longitudinally and communicating with one of the adjacent receiving groove, the through holes is used for mounting a conducting sheet, the conducting sheet insulates from the enclosure, opposite ends of the conducting sheet are electrically connected to the second contact and the third contact;

the other of the at least one protrusions defines the at least one limiting hole;

the cross section of the enclosure is substantially sector shaped;

the enclosure is integrally formed by aluminium; and the at least one limiting hole comprises two limiting holes, the at least two protrusions comprises three protrusions, each protrusion is arranged between two of the receiving groove, one of the protrusions defines the through hole, the rest two protrusions defines the two limiting holes.

* * * * *